US006786831B1

(12) United States Patent
Wu

(10) Patent No.: US 6,786,831 B1
(45) Date of Patent: Sep. 7, 2004

(54) GOLF PRACTICING DEVICE HAVING AUTOMATIC RESTORING FUNCTION

(75) Inventor: Ming-Che Wu, Chia-Yi (TW)

(73) Assignee: Acas Design Co., Ltd., Chia-Yi (TW)

( * ) Notice: Subject to any disclaimer, the term of this patent is extended or adjusted under 35 U.S.C. 154(b) by 0 days.

(21) Appl. No.: 10/747,336

(22) Filed: Dec. 29, 2003

(51) Int. Cl.[7] ..... A63B 69/36
(52) U.S. Cl. ..... 473/140; 473/149
(58) Field of Search ..... 473/138, 139, 473/140, 141, 142, 143, 144, 145, 146, 147, 148, 149

(56) References Cited

U.S. PATENT DOCUMENTS 1,690,158 A * 11/1928 Currie ..... 473/146
1,976,405 A * 10/1934 Le Witt ..... 473/146
5,390,930 A * 2/1995 Hu et al. ..... 473/149
5,513,847 A * 5/1996 Hu et al. ..... 473/140
5,997,405 A * 12/1999 Russell et al. ..... 473/140
6,254,491 B1 * 7/2001 Chou ..... 473/140
6,425,830 B1 * 7/2002 Chou ..... 473/140

* cited by examiner

*Primary Examiner*—Gregory Vidovich
*Assistant Examiner*—Nini F. Legesse
(74) *Attorney, Agent, or Firm*—Charles E. Baxley

(57) ABSTRACT

A golf practicing device includes a housing, an electromagnet mounted in the housing, a cover rotatably mounted on the housing, a magnetic block secured on the cover and aligning with the electromagnet, and a bar mounted on the cover for rotating the cover when the bar is hit. Thus, the energized electromagnet produces a magnetic force to magnetically attract and move the magnetic block to return the bar to the original position, so that the bar can be restored to the original position automatically, thereby facilitating the user practicing the golf skill.

9 Claims, 4 Drawing Sheets

GOLF PRACTICING DEVICE HAVING AUTOMATIC RESTORING FUNCTION

BACKGROUND OF THE INVENTION

1. Field of the Invention

The present invention relates to a golf practicing device, and more particularly to a golf practicing device having an automatic restoring function.

2. Description of the Related Art

A conventional golf practicing device comprises a rotation disk, and a bar having a first end mounted on the a rotation disk and a second end formed with a practicing ball. Thus, the user can practicing the golf skills indoors by striking the practicing ball. However, the bar is rotated successively when being hit and cannot be returned to the original position automatically, so that the user has to wait until the bar stop moving or exert a force to stop movement of the bar, thereby causing inconvenience to the user.

SUMMARY OF THE INVENTION

The primary objective of the present invention is to provide a golf practicing device having an automatic restoring function.

Another objective of the present invention is to provide a golf practicing device, wherein the energized electromagnet mounted in the housing produces a magnetic force to magnetically attract and move the magnetic block mounted in the cover to return the bar to the original position, so that the bar can be restored to the original position automatically, thereby facilitating the user practicing the golf skill.

In accordance with the present invention, there is provided a golf practicing device, comprising a housing;

an electromagnet mounted in the housing;

a cover rotatably mounted on the housing;

a magnetic block secured on the cover to rotate therewith and aligning with the electromagnet; and a bar having an end mounted on the cover for rotating the cover when the bar is hit.

Further benefits and advantages of the present invention will become apparent after a careful reading of the detailed description with appropriate reference to the accompanying drawings.

BRIEF DESCRIPTION OF THE DRAWINGS

FIG. 2A is a perspective view of a housing of the golf practicing device as shown in FIG. 2;

FIG. 2B is a perspective view of a cover of the golf practicing device as shown in FIG. 2;

FIG. 2C is a perspective view of a rotation disk of the golf practicing device as shown in FIG. 2;

DETAILED DESCRIPTION OF THE INVENTION

Figure 1:
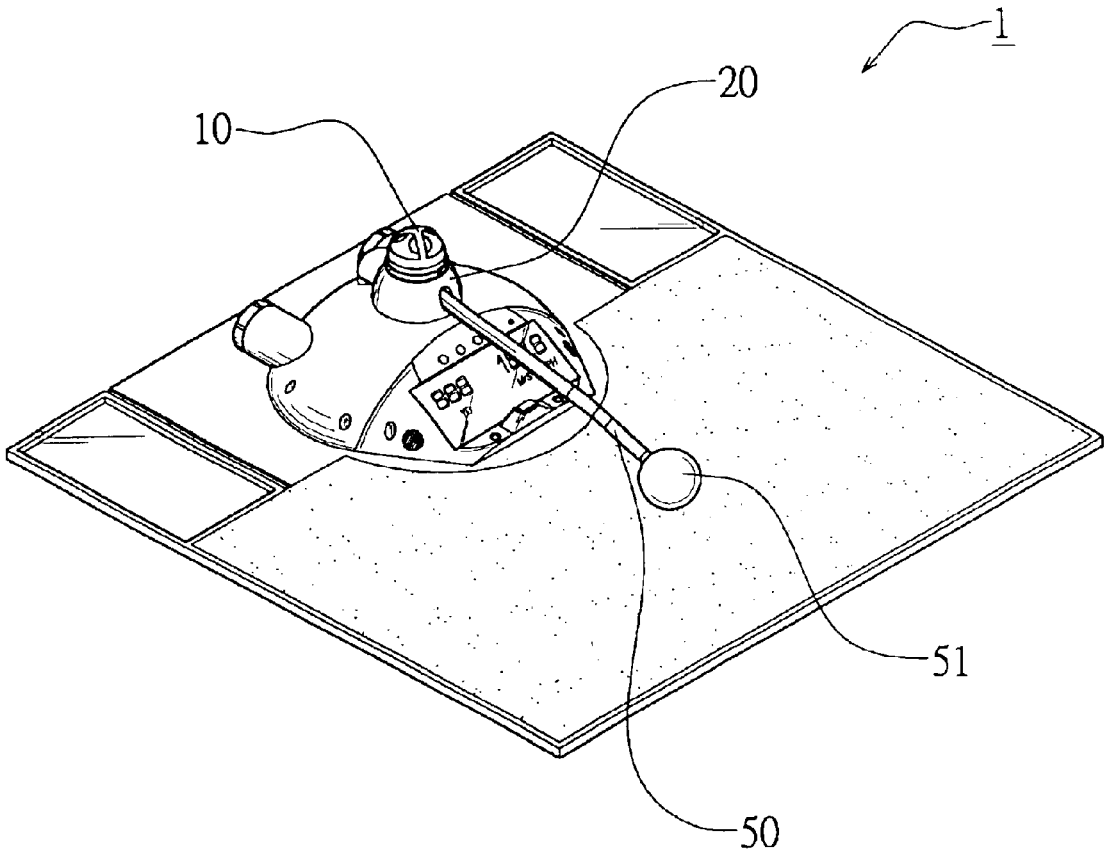
FIG. 1 is a perspective view of a golf practicing device in accordance with the preferred embodiment of the present invention.
Figure 2:
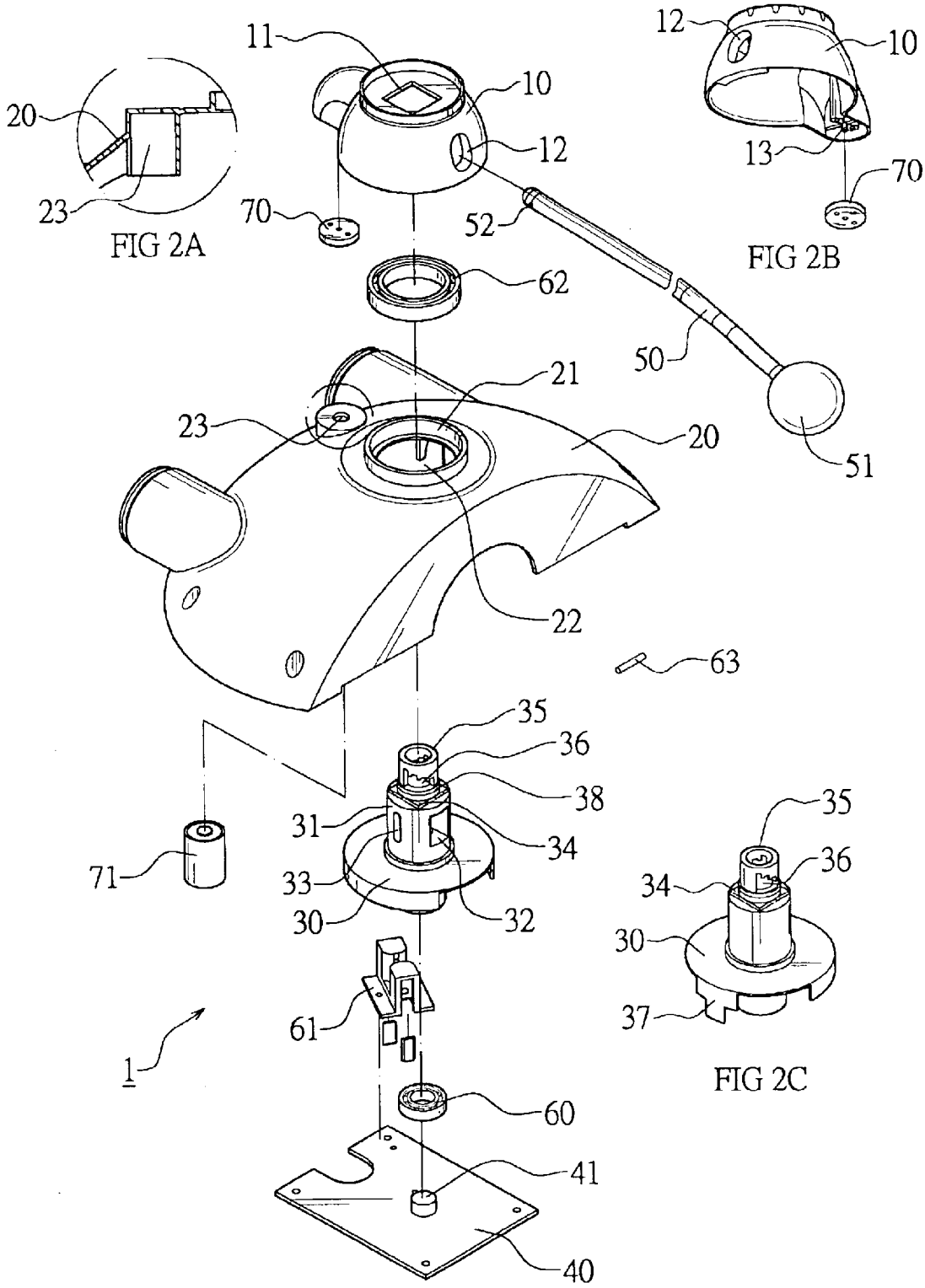
FIG. 2 is an exploded perspective view of the golf practicing device as shown in FIG. 1.
Figure 3:
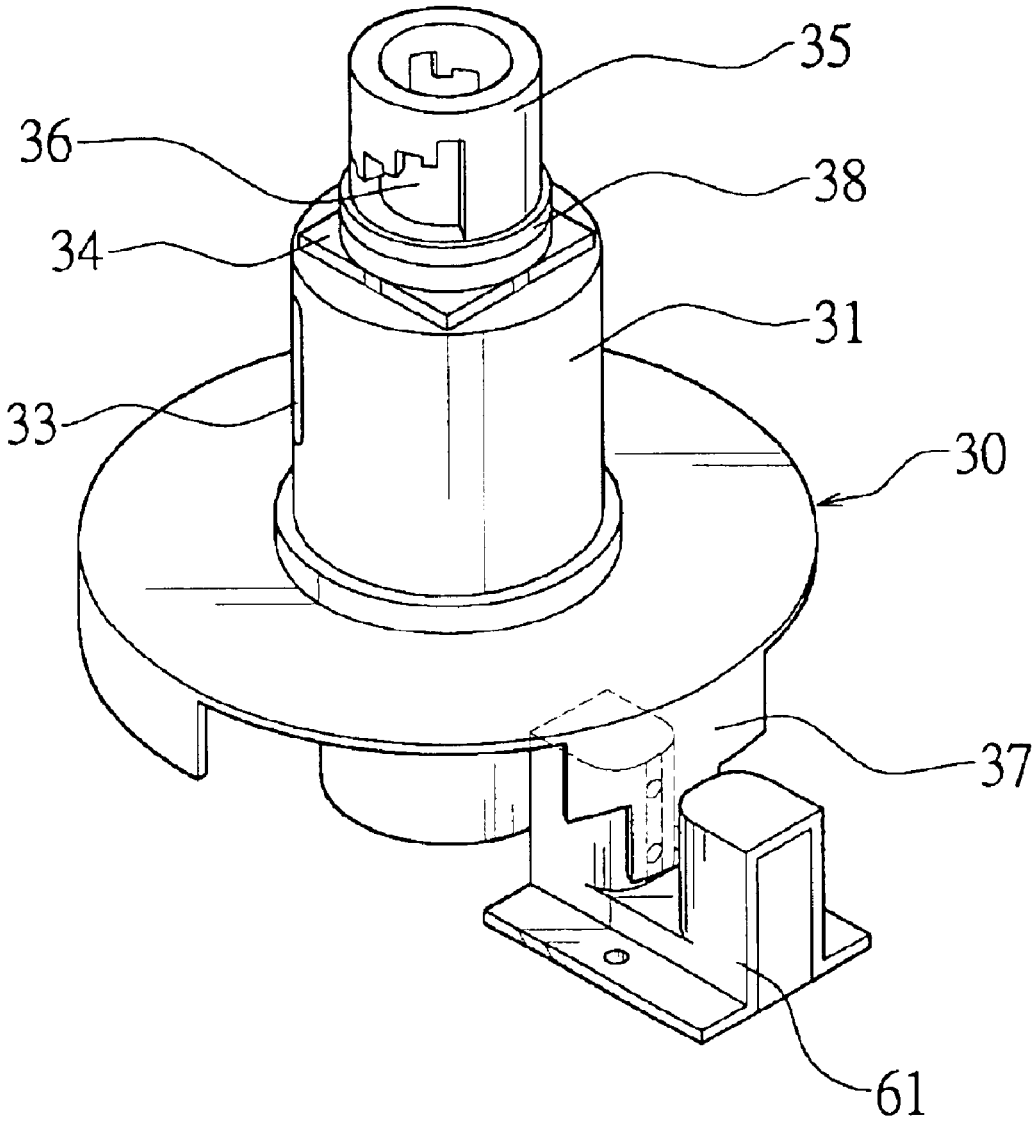
FIG. 3 is a partially perspective view of the golf practicing device in accordance with the preferred embodiment of the present invention.

Referring to the drawings and initially to FIGS. 1–3, a golf practicing device 1 in accordance with the preferred embodiment of the present invention comprises a housing 20, a support plate 40, a rotation disk 30, a cover 10, and a bar 50.

The housing 20 has an upper portion formed with a recess 21 and a through hole 22 communicating with the recess 21. The housing 20 has a periphery formed with chamber 23 (see FIG. 2A). An electromagnet 71 is mounted in the chamber 23 of the housing 20.

The support plate 40 is secured in the housing 20 and is provided with a bearing seat 41. A sensor 61 is mounted on the support plate 40.

The rotation disk 30 is rotatably mounted on the support plate 40 and located in the housing 20. The rotation disk 30 has a periphery formed with a protruding sensing portion 37 (see FIG. 2C) that is movable to pass through the sensor 61 as shown in FIG. 3.

The rotation disk 30 is provided with a first barrel 31 and a second barrel 35. The first barrel 31 of the rotation disk 30 has a diameter greater than that of the second barrel 35. The first barrel 31 of the rotation disk 30 is extended through the through hole 22 of the housing 20 and has a first end rotatably mounted on the bearing seat 41 of the support plate 40 by a bearing 60 and a second end formed with an insert 34. A bearing 62 is mounted in the recess 21 of the housing 20 and rotatably mounted between the first barrel 31 of the rotation disk 30 and the housing 20. The first barrel 31 of the rotation disk 30 has a periphery formed with an opening 32 and two opposite slide slots 33 each communicating with the opening 32.

The second barrel 35 of the rotation disk 30 has a first end extended from the second end of the first barrel 31 of the rotation disk 30 and formed with an outer thread 38. The second barrel 35 of the rotation disk 30 has a periphery formed with two opposite limit grooves 36.

The cover 10 is rotatably mounted on the housing 20 and secured on the first end of the first barrel 31 of the rotation disk 30 to rotate therewith. The cover 10 has a first side formed with a through hole 11 and a second side formed with a support rod 13 (see FIG. 2B). A magnetic block 70 is secured on the support rod 13 of the cover 10 and aligning with the electromagnet 71 mounted in the chamber 23 of the housing 20. The cover 10 has a periphery formed with an oblong slot 12. The insert 34 of the first barrel 31 is inserted into the through hole 11 of the cover 10. The second barrel 35 of the rotation disk 30 has a second end protruded outward from the cover 10. A nut 64 (see FIG. 4) is screwed on the outer thread 38 of the second barrel 35 and rested on the cover 10 to secure the cover 10 on the rotation disk 30 to rotate therewith.

The bar 50 is pivotally mounted on the cover 10 and has a first end extended through the oblong slot 12 of the cover 10 and pivotally mounted in the opening 32 of the first barrel 31. The first end of the bar 50 is formed with a through hole 52 aligning with the two opposite slide slots 33 of the first barrel 31. A pin 63 is extended through the through hole 52 of the bar 50 and is movably mounted in the two opposite slide slots 33 of the first barrel 31, so that the first end of the bar 50 is pivotally movable in the first barrel 31 of the rotation disk 30. The bar 50 has a second end formed with a practicing ball 51.

Figure 4A:
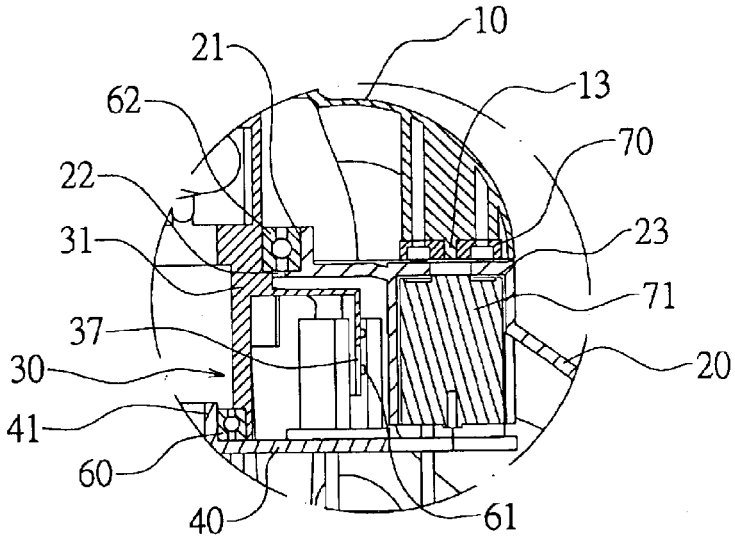
FIG. 4A is a partially enlarged view of the golf practicing device as shown in FIG. 4.
Figure 4:
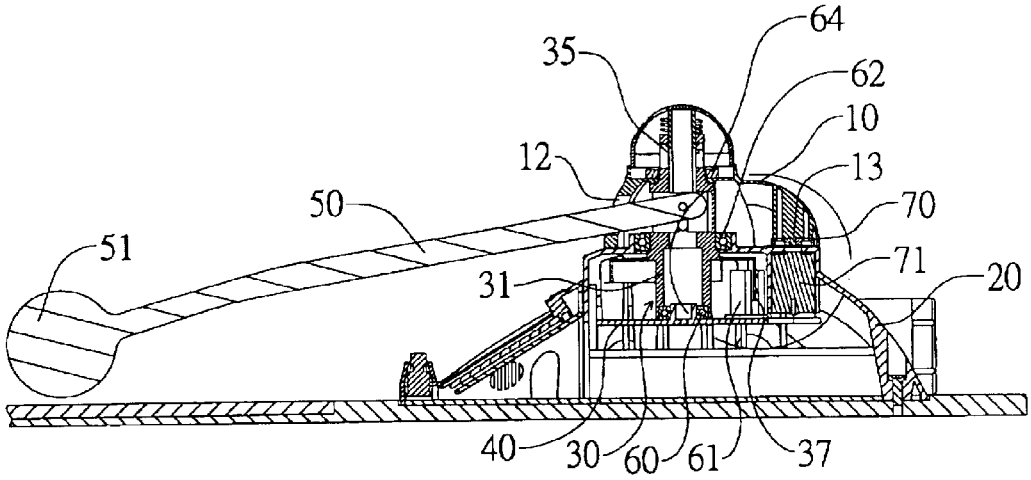
FIG. 4 is a side plan cross-sectional view of the golf practicing device as shown in FIG. 1.

In operation, referring to FIGS. 4 and 4A with reference to FIGS. 1–3, when the practicing ball 41 of the bar 40 is hit, the bar 40 is driven to rotate the cover 10 and the rotation disk 30, so that the sensing portion 37 of the rotation disk 30 is moved to pass through the sensor 61 as shown in FIG. 3. When the rotation speed of the rotation disk 30 is reduced, the sensor 61 can detect reduction of the rotation speed of the rotation disk 30 by movement of the sensing portion 37 of the rotation disk 30, and send a signal to a circuit board (not shown) mounted in the housing 20 to energize the electromagnet 71 mounted in the chamber 23 of the housing 20, so that the electromagnet 71 produces a magnetic force to magnetically attract and move the magnetic block 70 mounted in the cover 10 so as to return the cover 10, the rotation disk 30 and the bar 40 to the original position as shown in FIG. 1, so that the bar 40 can be restored to the original position automatically, thereby facilitating the user practicing the golf skill.

Accordingly, the energized electromagnet 71 mounted in the housing 20 produces a magnetic force to magnetically attract and move the magnetic block 70 mounted in the covet 10 to return the bar 40 to the original position, so that the bar 40 can be restored to the original position automatically, thereby facilitating the user practicing the golf skill.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A golf practicing device, comprising a housing;

an electromagnet mounted in the housing;

a cover rotatably mounted on the housing;

a magnetic block secured on the cover to rotate therewith and aligning with the electromagnet; and a bar having an end mounted on the cover for rotating the cover when the bar is hit.

2. The golf practicing device in accordance with claim 1, wherein the electromagnet is energized to produce a magnetic force to magnetically attract and move the magnetic block to return the cover and the bar to an original position.

3. The golf practicing device in accordance with claim 1, wherein the housing has a periphery formed with chamber, and the electromagnet is mounted in the chamber of the housing.

4. The golf practicing device in accordance with claim 1, wherein the cover is formed with a support rod, and the magnetic block is secured on the support rod of the cover.

5. The golf practicing device in accordance with claim 1, further comprising a support plate secured in the housing and provided with a bearing seat, and a sensor mounted on the support plate.

6. The golf practicing device in accordance with claim 5, further comprising a rotation disk rotatably mounted on the support plate and located in the housing, wherein the rotation disk has a periphery formed with a protruding sensing portion that is movable to pass through the sensor.

7. The golf practicing device in accordance with claim 6, wherein the rotation disk is rotatably mounted on the bearing seat of the support plate by a bearing.

8. The golf practicing device in accordance with claim 6, wherein the cover is secured on the rotation disk to rotate therewith.

9. The golf practicing device in accordance with claim 1, wherein the housing has an upper portion formed with a recess and a through hole communicating with the recess, the rotation disk is extended through the through hole of the housing, and the golf practicing device further comprises a bearing mounted in the recess of the housing and rotatably mounted between the rotation disk and the housing.

* * * * *